US005454743A

United States Patent [19]

Simonson

[11] Patent Number: 5,454,743

[45] Date of Patent: Oct. 3, 1995

[54] FREE STYLE SURFBOARD WITH REMOVABLE FOOT PIECES

[76] Inventor: Eric Simonson, 2455 Newport Ave., Cardiff, Calif. 92007

[21] Appl. No.: 977,606

[22] Filed: Nov. 17, 1992

[51] Int. Cl.[6] ..... B63B 35/79

[52] U.S. Cl. ..... 441/74; 24/306; 428/100

[58] Field of Search ..... 441/65, 67, 74, 441/79, 129, 83, 65 A, 343, 359, 361, 364; 24/306, 369; 36/59 R, 66, 1, 113, 8.1, 132, 136

[56] References Cited

U.S. PATENT DOCUMENTS

| | | | |
|---|---|---|---|
| 3,050,751 | 8/1962 | Moon | 9/310 |
| 4,108,452 | 8/1978 | Baron | 280/11.3 |
| 4,285,082 | 8/1981 | Cox | 9/310 E |
| 4,617,214 | 10/1986 | Billarant | 24/306 |
| 4,645,466 | 2/1987 | Ellis | 441/74 |
| 4,897,063 | 1/1990 | Scheurer | 441/74 |
| 4,913,077 | 4/1990 | Bectarte | 441/74 |
| 4,964,825 | 10/1990 | Paccoret | 441/74 |
| 5,145,430 | 9/1992 | Keys | 441/74 |
| 5,167,552 | 12/1992 | Johnson | 441/74 |
| 5,170,574 | 12/1992 | Weisbrich | 36/136 |
| 5,200,245 | 4/1993 | Brodrick | 24/306 |

*Primary Examiner*—Robert J. Oberleitner
*Assistant Examiner*—C. Bartz
*Attorney, Agent, or Firm*—Klein & Szekeres

[57] ABSTRACT

A surfboard has ribbed or corrugated side rails for improved strength without an increase in weight. In a first embodiment, the board comprises a rigid, buoyant foam core, over which a rigid shell is formed, the shell having side rails with at least one external longitudinal rib. In a second embodiment, the board comprises an injection-molded plastic shell, into which a buoyant foam material is injected. The shell is formed with at least one internal longitudinal rib along each side rail. A portion of the top surface of the surfboard is covered with a layer of unbroken loop nylon material overlying a layer of closed cell foam material to form a resilient, non-abrasive, slip-resistant, water-repellent mat. A foot piece having a sole portion of unbroken loop nylon material is removably attachable to the mat by a double-sided patch of fibrous hook material.

17 Claims, 2 Drawing Sheets

FIG. 6
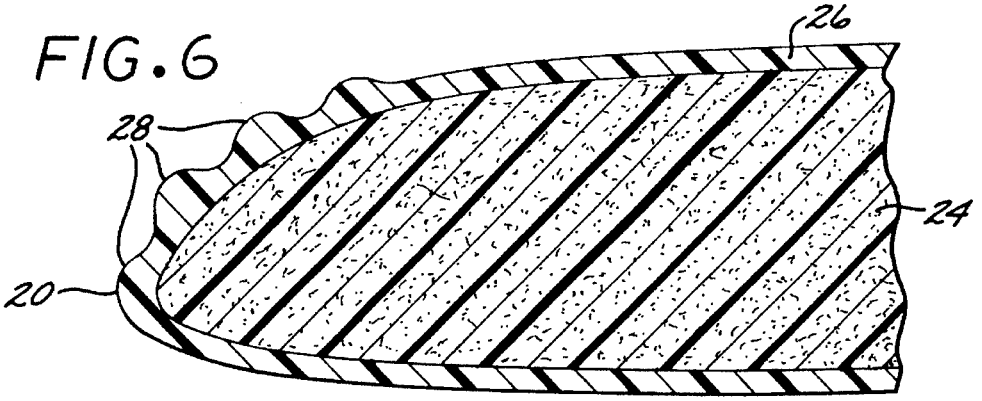
FIG. 7
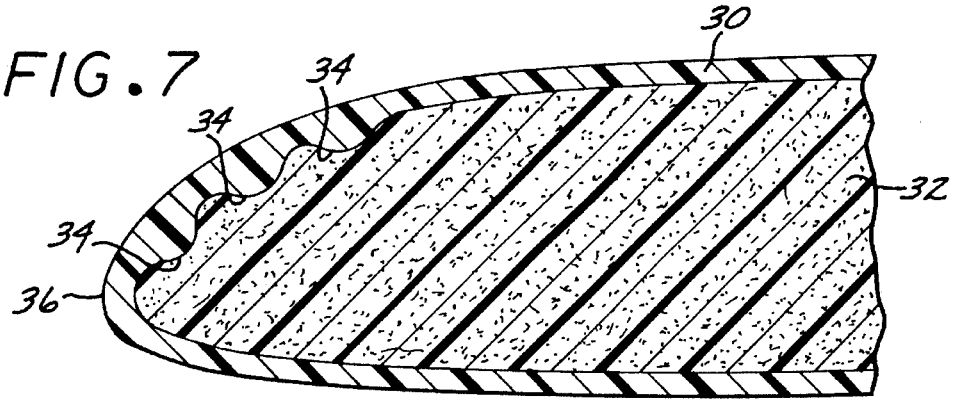
FIG. 8
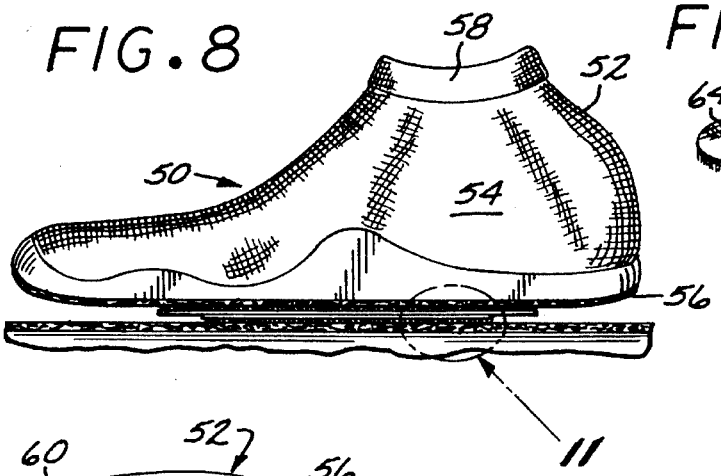
FIG. 9
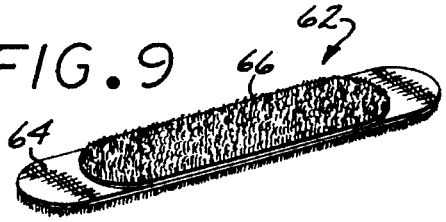
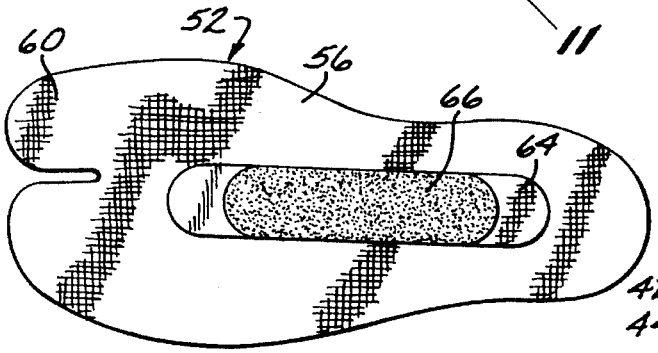
FIG. 10
FIG. 11
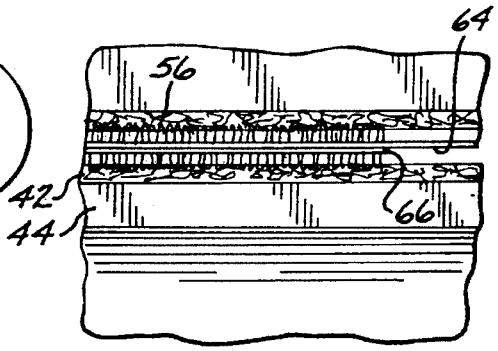

FREE STYLE SURFBOARD WITH REMOVABLE FOOT PIECES

BACKGROUND OF THE INVENTION

This invention relates to the field of surfboards. More specifically, it relates to a surfboard having improved strength-to-weight characteristics, and that includes removable foot retaining accessories that provide improved adhesion between the board and the user's feet.

The sport of surfing has undergone a number of changes over the years, with resulting changes in the style and construction of the surfboards themselves. For example, surfboards were originally constructed of wood, and had an overall length of about 8 feet (2.44m). These "long boards" eventually gave way to "short boards", that provided improved maneuverability and easier transportability, as compared to long boards. The short boards, about 6 feet (1.83m) in length, and formed of a fiberglass shell with a plastic foam core, have allowed surfers to perform ever more complex stunts, and have largely (although not completely) supplanted long boards.

As a general rule, the lighter the board, the more maneuverable it is. Nevertheless, the trade-off for reduced weight is generally reduced strength. Thus, with current materials, there are limits as to how thin (and thus how light) the boards can be. To keep the strength-to-weight characteristics of the short boards to acceptable levels, they are generally manufactured with a longitudinal stiffening member, or "stringer" down the center. The stringer, usually formed of a hard wood, provides the needed strength, but it also adds complexity and cost to the manufacturing process. Furthermore, the need for a stringer makes injection molding of the shell impractical. The core must first be formed with the stringer, and then the shell must be fabricated around the core, a laborious, expensive, and time-consuming process.

Even with shorter lengths and lighter weights, there are limits to the maneuverability of surfboards, due to the tendency, in certain stunts, for the user's feet to lose their grip on the board. One proposed solution to this problem, suggested in U.S. Pat. No. 4,285,082 to Cox and U.S. Pat. No. 4,645,466 to Ellis, is to provide a foot piece (such as a boot or slipper) and a portion of the board's surface with interlocking fibrous hook-and-loop fasteners, of the type marketed under the trademark VELCRO. These proposed solutions, however, are themselves subject to certain disadvantages.

For example, the fibrous hook-and-loop material absorbs and retains water. This can lead to eventual deterioration of the material. Furthermore, the hook-and-loop material provides a rough surface on the board, leading to irritation of the surfer's skin when he or she lies prone on the board to paddle it. In addition, the hook-and-loop material in these prior art devices is permanently attached to the board's surface, thereby making barefoot surfing quite uncomfortable, due to the chafing of the material against the skin. It is also noted that the hook-and-loop material in the Ellis apparatus is specially designed to restrain horizontal movement only, and does not restrain vertical movement.

Thus, there is an unmet need in the surfboard art for a light-weight, highly maneuverable board that has good strength-to-weight characteristics, without the need for a stringer. There is also an unmet need for a surfboard construction that allows for greater adhesion between the surfer's foot and the board's surface, but which can withstand repeated and prolonged exposure to salt water, and which allows skin contact with the board without irritation or undue discomfort.

SUMMARY OF THE INVENTION

The present invention is a surfboard that is novel in at least two broad aspects. In the first aspect, the invention is a surfboard having sides or "rails" that include a plurality of integral, longitudinal ribs or corrugations, thereby providing sufficient structural rigidity and strength to eliminate the need for a stringer, while allowing the board to be thin and light in weight. Moreover, by eliminating the stringer, the board can be made with an injection-molded shell, that is subsequently filled with foam to provide the core, thereby significantly lowering the cost of manufacture.

In the second aspect, the invention is a surfboard having a portion of its upper surface covered with a layer of unbroken loop nylon overlying a layer of closed cell foam material, thereby forming a resilient, non-skid, water-repellent mat. The mat by itself provides improved traction or adhesion for the surfer, while providing a smooth-textured, resilient surface that will not abrade the skin. Optimally, the board is used with a special foot piece in the form of a stretchable nylon sock, having a sole formed of the same unbroken loop nylon material. It is a characteristic of the unbroken loop nylon that it removably adheres to the fibrous hook portions of typical hook-and-loop fasteners, much as the loop portion of conventional hook-and-loop material does. Taking advantage of this characteristic, a double-sided patch of the fibrous hook portion of conventional hook-and-loop material is applied to the sole of the foot piece, with one "hook" surface removably adhering to the unbroken loop nylon sole of the foot piece, and the opposite "hook" surface removably adhering to the unbroken loop nylon surface of the mat. Optimally, the double-sided patch has a larger surface area of fibrous hook material on the surface applied to the sole of the foot piece, so that the patch adheres more strongly to the foot piece than to the board.

The above-described use of a foot piece that is removably attached to the surface of the board by means of the removable adhesion between the fibrous hook material patch and the unbroken loop material of the mat provides a high degree of adhesion between the surfer's foot and the board, thereby resisting relatively strong forces normal to the plane of the board's surface. The result is that the board remains adhered to the foot during complex maneuvers that would otherwise cause the foot to separate from the board.

Moreover, the patch remains on the foot piece after separation from the board (for example, when the surfer intentionally lifts the foot off the board), thereby both allowing the surfer readily to change positions on the board, and minimizing the risk of loss of the patch. Furthermore, the patch can be easily changed, both to replace a worn patch, and to change to patches of different sizes and shapes, thereby changing the degree of adhesion between the foot piece and the board, to accommodate the varying styles and skill levels of surfing.

One result of the above-described structure is that the board can be used for highly complex maneuvers, of a type that would be difficult, if not impossible, with conventional boards. Such maneuvers may be termed "free style" surfing.

In summary, the combination of features described above yields a surfboard that is light, strong, and highly maneuverable, and that is also simple and economical to manufacture. In addition, the mat of unbroken loop nylon, combined with the foot piece and the patch of double-sided fibrous hook material, provides a high degree of foot-to-board adhesion, while also eliminating or minimizing the problems of skin abrasion and deterioration due to exposure to salt water.

These and other advantages of the present invention will be more fully appreciated from the detailed description that follows.

BRIEF DESCRIPTION OF THE DRAWINGS

FIG. 6 is a cross-sectional view taken along line 6—6 of FIG. 1;

FIG. 7 is a cross-sectional view, similar to that of FIG. 6, showing an alternative construction for the surfboard;

FIG. 8 is a side elevational view of the removably attachable foot piece used with the surfboard of FIG. 1, showing, in cross-section, the attachment of the foot piece to the board;

FIG. 9 is a perspective view of the attachment patch used to attach the foot piece to the surfboard;

FIG. 10 is a bottom plan view of the foot piece shown in FIG. 8; and

FIG. 11 is a detailed view of the portion enclosed within the broken outline 11 in FIG. 8.

DETAILED DESCRIPTION OF THE PREFERRED EMBODIMENT

Figure 1:
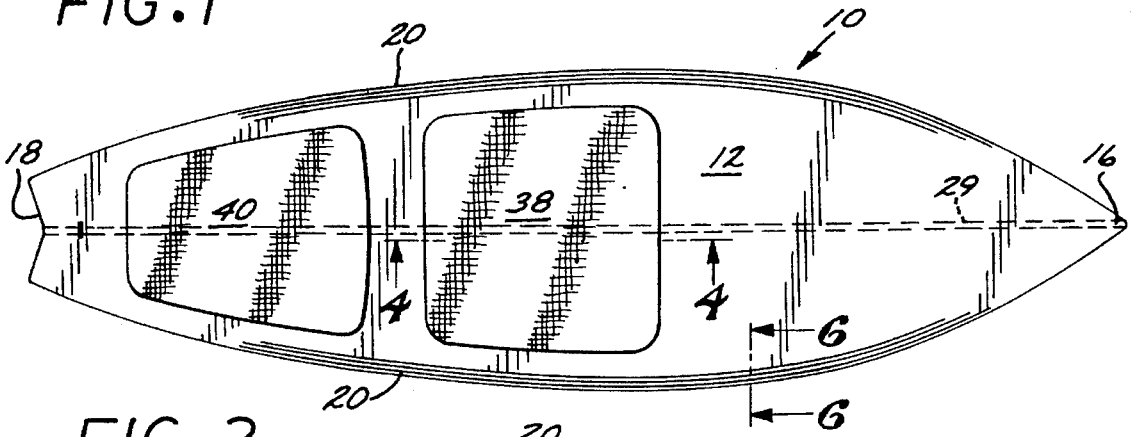
FIG. 1 is a top plan view of a surfboard in accordance with a preferred embodiment of the invention.
Figure 2:
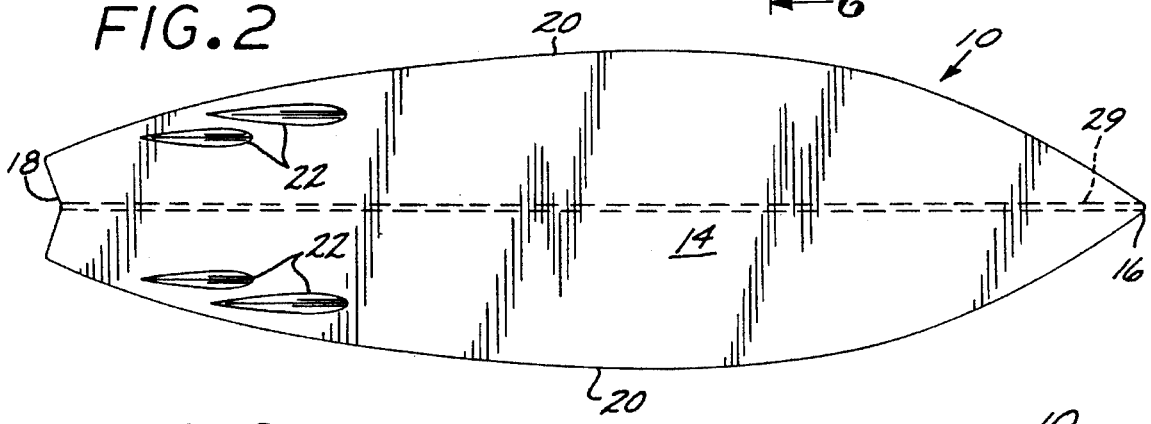
FIG. 2 is a bottom plan view of the surfboard of FIG. 1.
Figure 3:
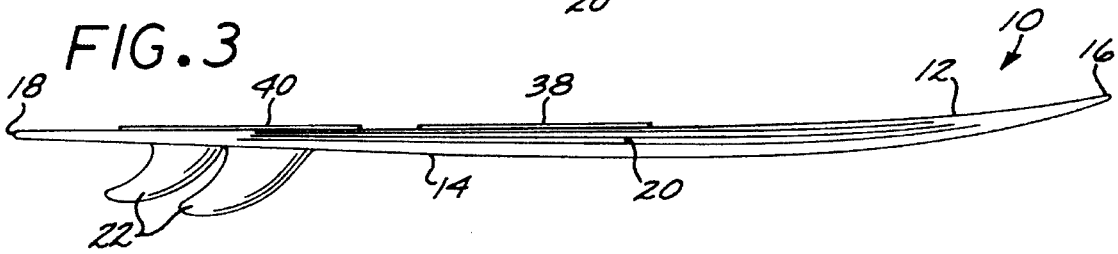
FIG. 3 is a side elevational view of the surfboard of FIG. 1.

Referring now to the drawings, FIGS. 1, 2, and 3 show a surfboard 10, constructed in accordance with a preferred embodiment of the present invention. The board 10 has a top surface 12, a bottom surface 14, a front or bow 16, and a rear or stern 18. The top surface 12 and the bottom surface 14 are joined along a pair of side rails 20. The bow 16 is preferably pointed as shown, and curved slightly upward out of the plane of the top surface 12. The stern 18 is preferably formed with an angular indentation as shown. Extending downward from the bottom surface 14 near the stern 18 are several stabilizer fins or keels 22. Four keels 22 are shown, two adjacent each of the rails 20, but this number may be varied.

The surfboard 10 may be constructed in accordance with either of two fabrication techniques, illustrated in FIGS. 6 and 7, respectively. In the FIG. 6 embodiment, the board 10 comprises a core 24 of a buoyant foam material, such as rigid polyurethane foam. Applied over the foam core 24 is a rigid outer shell 26 of fiberglass, or a similar polyester resin. The shell 26 defines the top surface 12, the bottom surface 14, and the rails 20. In accordance with the present invention, the shell 26 is fabricated so that the rails 20 are formed with at least one longitudinal corrugation or rib 28, and preferably a plurality of such longitudinal ribs 28, as shown. Each of the ribs 28, formed in the exterior surface of the shell, extends along a substantial portion of the length of the side rail. The ribs 28 provide a substantial amount of structural rigidity to the board, such that the central longitudinal stiffening member or "stringer" of prior art boards may be eliminated. Nevertheless, if additional strength and rigidity is desired, a hard wood stringer 29 may be provided, as shown in FIGS. 1 and 2, and as described above.

Because the ribs 28 eliminate the need for a stringer, an alternative fabrication technique, illustrated in FIG. 7, may be used. In this alternative fabrication method, a shell 30 is first injection-molded from a suitable rigid polymeric plastic, and then filled (through a temporary fill aperture, not shown) with a polymeric foam, such as polyurethane, to form a core 32, the fill aperture then being sealed. With this method of construction, the shell 30 is provided with at least one longitudinal rib 34 on its interior surface, and preferably a plurality of such internal ribs 34, as shown. Each of the internal ribs 34 extends along a substantial portion of the length of the side rail on the lateral edges of the core 32. Viewed another way, in this second embodiment, the board has a pair of longitudinal rails 36 (only one of which is shown in FIG. 7), which are internally corrugated to provide the structural strength and rigidity. Alternatively, a shell can be injection-molded so as to have external ribs or corrugations, as does the previously-described FIG. 6 embodiment.

Figure 4:
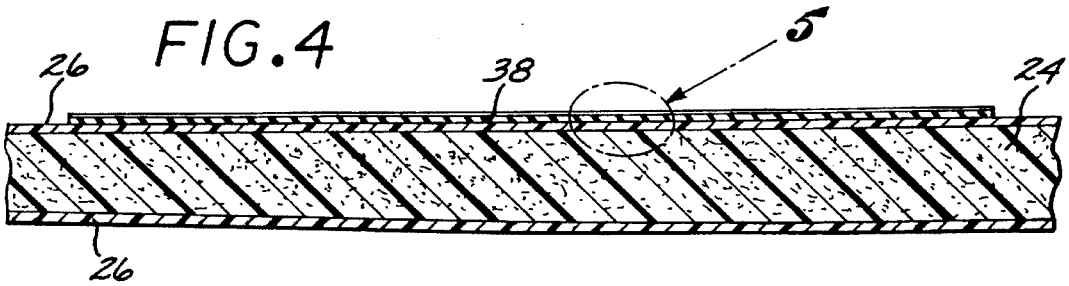
FIG. 4 is a cross-sectional view taken along line 4—4 of FIG. 1.
Figure 5:
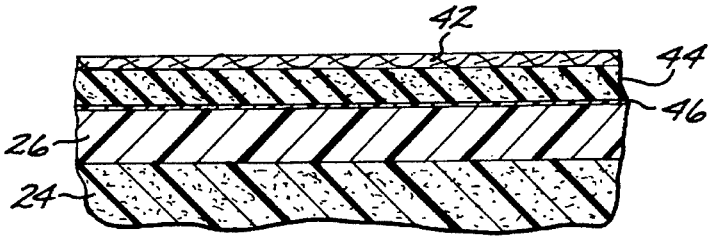
FIG. 5 is a detailed view of the portion enclosed within the broken outline 5 of FIG. 4.

Referring now to FIGS. 1, 4, and 5, the top surface 12 of the board 10 is provided a front mat 38 and a rear mat 40. Each of the mats 38 and 40 comprises a surface layer 42 of unbroken loop nylon material, permanently bonded to a backing layer 44 of resilient, closed cell neoprene foam. Uncut sheets of unbroken loop nylon bonded to neoprene foam are available from Rubatex Corp., of Bedford, Va., under the trademark "UBL 208". Such sheets are cut to the required sizes and shapes of the mats 38 and 40, and are then adhesively attached to the top surface 12 of the board 10 by a pressure-sensitive adhesive tape 46, such as "Scotch" Brand No. 950 tape, marketed by the 3M Corp, of Minneapolis, Minn.

The mats 38 and 40 form resilient, high traction areas on the board that provide relatively soft, smooth, slip-resistant surfaces. Thus, a surfer's feet are provided with a better grip on the board, without risk of abrasion to the skin when paddling. Moreover, the material of the mats is water-repellent, and thus does not significantly deteriorate due to prolonged exposure to salt water.

While two mats are shown in the preferred embodiment, it is understood that one mat, or perhaps three, can be used, of varying shapes and sizes to suit the needs of the individual surfer.

The board 10 is optimally used with a pair of foot retention accessories 50, one of which is shown in FIGS. 8–11. The foot retention accessory 50 comprises a sock-like foot piece 52, having an upper portion 54 formed primarily of an elastomeric, rubberized nylon, of the type marketed under the trademark "Spandex". The upper portion 54 is sewn to a sole portion 56 formed of the same unbroken loop nylon material as surface layer 42 of the mats 38 and 40. The foot piece 52 has an elastic ankle band 58, and preferably has a separate toe compartment 60 for the big toe.

The foot piece is removably attachable to either of the mats 38 and 40 by means of an attachment patch 62. The attachment patch comprises a sole strip 64 and a mat strip 66, both formed of fibrous hook material, such as the hook portions of conventional hook-and-loop fasteners. The longer sole strip 64 and the shorter mat strip 66 are adhesively attached to one another in back-to-back fashion, so that the fibrous hook surfaces are exposed. The hook surfaces removably adhere to the unbroken loop nylon material on the mats 38 and 40, and on the sole portion 56 of the foot piece 52, so that the sole strip 64 can be removably attached to the sole portion 56, and the mat strip 66 can be removably attached to either of the mats 38 and 40, as shown in FIGS. 8 and 11.

Preferably, the sole strip 64 has a greater hook surface area than the mat strip 66, so that there is a stronger adhesion between the patch 62 and the foot piece 52, than there is between the patch 62 and the mat 38 or 40. The patch 62 will thus remain attached to the foot piece 52 upon separation of the foot piece 52 from the mat, allowing the surfer to change foot position by simply lifting and replanting his or her foot, without the need separately to remove and reattach the patch 62. By minimizing the degree to which the patch 62 needs to be handled, this arrangement also minimizes the risk of losing the patch.

The patch 62 can be readily changed for replacement when worn, and the size and shape of the patch 62 can be varied to accommodate the needs and desires of the individual surfer. Some surfers, for example, may wish to have a larger surface area for the patch, to provide a greater degree of adhesion between the foot piece and the board, while others may wish a smaller surface area, and thus less adhesion. In any event, the patch provides sufficient adhesion between the foot piece and the board to resist relatively strong lifting forces that are normal to the board's surface. The adhesion between the foot piece and the mat also resists lateral forces (i.e., those parallel to the plane of the board's top surface), thereby reducing slippage to a minimum. The result is that the board remains adhered to the foot during complex maneuvers, that would otherwise cause the foot and the board to become separated.

From the foregoing description, it can be seen that the present invention offers several advantages over prior art surfboards. Specifically, the corrugated or ribbed rail construction offers suitable structural strength without the need for a stringer, and without the need for added weight, thereby allowing for simpler, more economical methods of manufacture. The unbroken loop nylon/neoprene foam mats offer a non-slip surface that does not need waxing, and that is non-abrasive and resistant to the deteriorating effects of salt water. The removable foot retention accessories, combined with the mats, provide superior foot-to-board adhesion with the flexibility to vary the degree of adhesion to suit the needs of individual surfers. Sufficient adhesion is provided, in fact, to allow highly complex maneuvers to be performed by a skillful surfer, giving rise to the development of a new style of surfing, which may be termed "free style" surfing.

While a preferred embodiment of the invention has been described above, several variations and modifications may suggest themselves to those skilled in the pertinent arts. For example, as previously mentioned, the shape, size, and number of mats may be varied, as may be the shape and size of the fibrous hook patches. Also, while a foot piece having a separate toe compartment is preferred, a foot piece without such a separate compartment may be used. Furthermore, while the materials described above have been found suitable for the invention, alternative materials may be acceptable substitutes. These and other variations and modifications that may suggest themselves should be considered within the spirit and scope of the present invention, as defined in the claims that follow.

What is claimed is:

1. Surfing apparatus, comprising:

a surfboard having a top surface;

resilient, slip-resistant, substantially non-abrasive, substantially water-repellent traction means, attached to the top surface of the surfboard;

a foot piece formed and configured to fit onto a person's foot and including a sole portion; and attachment means for (a) removably attaching the foot piece to the traction means, and (b) resisting lateral and vertical forces between the foot piece and the traction means, thereby providing sufficient adhesion between the foot piece and the traction means to resist inadvertent separation of the foot piece from the traction means, wherein the attachment means comprises a patch having a first surface removably attachable to the sole portion, and a second surface attached to the first surface in a back-to-back fashion, the second surface being removably attachable to the traction means.

2. The surfing apparatus of claim 1, wherein the traction means comprises a mat attached to and covering a portion of the top surface of the surfboard.

3. The surfing apparatus of claim 2, wherein the mat comprises:

a first layer of resilient foam material, having an outer surface and an inner surface;

a second layer of unbroken loop nylon material bonded to the outer surface of the first layer; and means for adhesively attaching the inner surface of the first layer to the top surface of the surfboard.

4. The surfing apparatus of claim 3, wherein the foot piece includes a sole portion of unbroken loop nylon material, and wherein the attachment means comprises:

a first portion of fibrous hook fastening material that removably adheres to the sole portion; and a second portion of fibrous hook fastening material, attached to the first portion, that removably adheres to the second layer of the mat.

5. The surfing apparatus of claim 4, wherein the surface area of the first portion is greater than the surface area of the second portion.

6. The surfing apparatus of claim 1, wherein the surfboard includes a unitary, rigid, external shell having a bottom surface joining the top surface along a pair of longitudinal side rails, and wherein each of the side rails includes an integral longitudinal rib extending along a substantial portion of the length thereof.

7. The surfing apparatus of claim 6, wherein the surfboard comprises an internal core of rigid, buoyant foam material contained within the rigid external shell, wherein the shell has an interior surface and an exterior surface, and wherein the rib is formed as an integral corrugation along the interior surface of the shell.

8. The surfing apparatus of claim 6, wherein the surfboard comprises an internal core of rigid, buoyant foam material contained within the rigid external shell, wherein the shell has an interior surface and an exterior surface, and wherein the rib is formed as an integral corrugation along the exterior surface of the shell.

9. The surfing apparatus of claim 6, wherein the surfboard comprises an internal core formed of a unitary piece of rigid, buoyant, polymeric foam material contained within a rigid external shell formed of an injection-molded polymeric plastic.

10. A surfboard, of the type including an internal core of rigid, buoyant foam material contained within a one-piece rigid external shell having a top surface and a bottom surface joined along a pair of longitudinal side rails on either side of the shell, wherein the improvement comprises:

a longitudinal rib integral with and extending along a substantial portion of the length of each of the side rails.

11. The surfboard of claim 10, wherein shell has an interior surface and an exterior surface, and wherein the rib is formed as an integral corrugation on the exterior surface of the shell.

12. The surfboard of claim 10, wherein the shell has an interior surface and an exterior surface, and wherein the rib is formed as an integral corrugation on the interior surface of the shell.

13. The surfboard of claim 10, wherein the core is a single, unitary piece of polymeric foam material.

14. The surfboard of claim 13, wherein the shell is formed of an injection-molded polymeric plastic.

15. The surfboard of claim 10, wherein the improvement further comprises:

resilient, substantially non-abrasive, substantially water-repellent, traction means on the top surface, for providing a slip-resistant surface for the person's feet.

16. The surfboard of claim 15, wherein the traction means comprises a mat attached to and covering a portion of the top surface of the surfboard.

17. The surfboard of claim 16, wherein the mat comprises:

a first layer of resilient foam material, having an outer surface and an inner surface;

a second layer of unbroken loop nylon material bonded to the outer surface of the first layer; and means for adhesively attaching the inner surface of the first layer to the top surface of the surfboard.

* * * * *